US006918218B2

(12) United States Patent
Greenway

(10) Patent No.: US 6,918,218 B2
(45) Date of Patent: Jul. 19, 2005

(54) EXTERNAL INSULATED FINISH SYSTEM WITH HIGH DENSITY POLYSTYRENE LAYER

(76) Inventor: Robert Greenway, 5424 Pattison Dr. SE., Lacey, WA (US) 98513

( * ) Notice: Subject to any disclaimer, the term of this patent is extended or adjusted under 35 U.S.C. 154(b) by 86 days.

(21) Appl. No.: 10/453,432

(22) Filed: Jun. 2, 2003

(65) Prior Publication Data

US 2004/0006942 A1 Jan. 15, 2004

Related U.S. Application Data

(60) Provisional application No. 60/385,951, filed on Jun. 4, 2002.

(51) Int. Cl.[7] ..... E04B 2/02

(52) U.S. Cl. ..... 52/267; 52/268; 52/309.8; 52/309.12; 52/309.17; 52/408

(58) Field of Search ..... 52/408, 410, 411, 52/309.8, 309.12, 309.14, 309.17, 405.1, 506.01, 267, 268, 269

(56) References Cited

U.S. PATENT DOCUMENTS

| | | | | | |
|---|---|---|---|---|---|
| 3,389,518 | A | * | 6/1968 | Horbach | 52/309.8 |
| 3,445,406 | A | | 5/1969 | Koch | |
| 3,879,908 | A | * | 4/1975 | Weismann | 52/309.5 |
| 4,044,520 | A | * | 8/1977 | Barrows | 52/309.12 |
| 4,349,398 | A | * | 9/1982 | Kearns et al. | 156/71 |
| 4,646,498 | A | * | 3/1987 | Schneller et al. | 52/309.12 |
| 5,027,572 | A | * | 7/1991 | Purcell et al. | 52/309.9 |
| 5,410,852 | A | * | 5/1995 | Edgar et al. | 52/408 |
| 5,718,968 | A | | 2/1998 | Cutler | |
| 5,826,388 | A | * | 10/1998 | Irving | 52/302.1 |
| 5,979,131 | A | * | 11/1999 | Remmele et al. | 52/309.9 |
| 6,119,422 | A | * | 9/2000 | Clear et al. | 52/309.8 |
| 6,355,333 | B1 | * | 3/2002 | Waggoner et al. | 428/174 |
| 6,745,531 | B1 | * | 6/2004 | Egan | 52/302.1 |
| 2004/0067352 | A1 | * | 4/2004 | Hagerman et al. | 428/304.4 |

OTHER PUBLICATIONS

U.S. Appl. No. 60/385,951, Greenway, filed Jun. 4, 2002, Entire document.

* cited by examiner

*Primary Examiner*—Robert Canfield

(57) ABSTRACT

An External Insulated And Fixed System (EIFS) and method for making the same. The method provides a cost effective procedure for constructing an EIFS that can meet current hurricane high impact test protocol, especially for non-combustible EIFS "Systems". A reinforcing high impact layer of fiber glass mesh is eliminated, and a high-density compression molded expandable polystyrene board is provided that yields significantly improved impact resistance.

6 Claims, 3 Drawing Sheets

EXTERNAL INSULATED FINISH SYSTEM WITH HIGH DENSITY POLYSTYRENE LAYER

RELATED APPLICATIONS

A Provisional Application was submitted on Jun. 2, 2002, with a granted filing dated given of Jun. 4, 2002, by the United States Patent and Trademark Office, confirmation number 6794 under application No. 60/385,951.

BACKGROUND OF THE INVENTION

This invention relates to an improvement to the External Insulation And Finish System (EIFS), especially the non-combustible variation to the External Insulated And Finish System, which is mandated, when a non-combustible high impact resistant wall panel is required per municipal building code or architect preference, especially in hurricane or tornado areas of the United States.

EIFS, which is a type of cladding for exterior building walls, is defined per ASTM E631-91b as a "a non-loading outdoor wall finish system consisting of a thermal insulation board, an attachment system, a reinforced base coat, exterior joint sealant, and a compatible finish".

The development of EIFS occurred after World War II and was introduced to North America in the late 1960s or early 1970s as an EIFS called Dryvit™. While there are slight differences in the EIFS between the European and North American methods for the "System", there are mandatory components for the EIFS wall cladding in both cases.

As described in detail later herein, the mandatory components of a typical prior art EIFS (see FIG. 1), are: an interior finish 1; an interior wallboard 2; a stud 3 and sheathing substrate system 4, which the EIFS is attached, such as wood sheathing, mineral boards, an exterior grade or glass fiber-faced gypsum board, or cement board; insulation made of expandable polystyrene 6; attachment means for attaching the insulation to the substrate; a base coat adhesive 7 with reinforcing mesh 8 embedded in the adhesive located over the outside face of the EPS insulation board; and the finish 9, which is basically an esthetic part of the EIFS and is the visible portion of the wall system. This finish coat is typically made from an acrylic resin, which is either troweled or sprayed on, and a joint sealant system of which there are several types. Items 7, 8 and 9 are collectively referred to as the EIFS' " lamina".

The EIFS cladding is typically comprised of at least those components as described above. Each component has its own specification(s) with several manufacturers supplying any one component. A critical component of the system is the Expandable Polystyrene (EPS) insulation board. Expandable Polystyrene comes to the molding facility looking very much like a grain of sand, with a weight per cubic foot of about 64 pounds. The polystyrene beads included a thin outer layer of polystyrene and a hollow interior that includes a blowing agent, such as pentane. In pre-expanding, the beads are expanded by applying heat through hot air or steam, which causes the blowing agent to vaporize and expand the bead, to the desired density required for the second step, which is to mold the beads, through heat, steam, pressure and cooling, into the desired construct, for example; a panel, packaging material or helmet. Each construct has its own desired density requirements. In the EIFS industry the EPS beads are pre-expanded to its desired weight, which is from 0.9 to 1.1 pound(s) per cubic foot. This weight is about at the lowest limit EPS it can be pre-expanded to and molded.

In the EIFS industry this EPS board is required to have very specific characteristics, such as, it can be no less than ¾ of an inch thick, nor more than 4 inches thick, and needs to be pre-expanded to and molded at a density of one pound per cubic foot, plus or minus ten percent. EPS at one-pound density acts as a buffer or type of "shock" absorber, between the substrate and the "lamina", which is the base coat, mesh and finish or esthetic coat, as described as items 7, 8, and 9 above. The ability of the EPS to flex as the substrate moves, or the lamina expand and contracts, allows the EPS to absorb the energy of a shearing movement and to minimize the energy or stop the shearing energy from passing through the EPS to the lamina, which could cause it to crack and/or deform. EPS at a density of more than 1 pound per cubic foot is stiffer and has been found to not give the EPS board the elasticity, which helps to prevent deforming or cracking in the lamina. Accordingly, with EPS board made at higher densities the greater the tendency to transfer any build up of forces from the substrate to the lamina, that might otherwise cause deforming or cracking. In fact, EIFS manufacturers will not warrant their systems if the EPS insulation board is of the wrong density. By not using EPS and by instead applying the lamina directly to a substrate, any build up of forces in the substrate may be passed directly through it and could cause cracking in the lamina. The above describes the components, which are the integral parts of the External Insulated and Finish System (EIFS), and outlines why the EPS panels have a requirement by the EIFS manufacturers that the EPS board by made at 0.9 to 1-density.

It is known in the art that the EIFS cladding, when used in hurricane or tornado parts of the United States, are modified to include at least two more layers of mesh, in order to withstand the high impact of a foreign object as might occur during a hurricane or tornado. As later described in detail, FIG. 2 depicts a prior art cladding construct modified to withstand heavy impacts. These extra layers of mesh are required because EPS at one-pound density while flexible, is very fragile and can be crushed or punctured rather easily, when it is made with the industry standard base coat, fiberglass mesh and finish material, as depicted in FIG. 1 and noted as numbers 7,8 and 9. Building codes, such as those in Miami-Dade County Fla., have adopted a Hurricane Protocol. A component of the testing protocol is PA 201, the "Large Missile Impact Test", which is becoming the standard for building codes in hurricane and tornado regions of this country. There are several elements to the testing protocol, but of major concern in the EIFS industry is passing the large missile impact test. In this test, a 2×4 wood framing stud, about 9 feet long, is propelled from a "canon" at a speed of about 42 miles an hour at the surface of the object that is to be tested. The missile must not penetrate through the object tested to the inside of said object, or a test failure will occur. In the case of a wall panel, the missile must not crack or puncture the substrate so that light may be visible from the inside of the exterior wall cavity to an outside light source.

Improvements in the construction, with substantial cost savings of the above described External Insulated and Finish System, EIFS, are provided in accordance with this invention to achieve the same high impact non-combustible resistant panel system by providing a panel construct where the use of a high density expandable polystyrene panel, as is described in the teaching by Cutler in U.S. Pat. No. 5,718,968, is used in place of a layer of heavy weight fiberglass mesh. By using a high density EPS panel in place of a layer of fiberglass mesh, a savings in time and cost is achieved by doing away with the cost of the fiberglass mesh, the application of the adhesive, and the time and labor involved with embedding the fiberglass into the adhesive, with the attendant "down time" because of the need to allow the adhesive to dry and "set up".

By simply attaching, through screwing, gluing or nailing, the high density panel to the stud or its backing, a rather inexpensive alternative to the prior art EIFS has been accomplished. This high density panel at about 2 foot by 4 foot in dimension can be attached simply and quickly, especially when working on scaffolding many floors off of the ground since it is reasonably light in weight yet offers the impact resistance that is currently required in the EIFS construct by building codes in certain hurricane and tornado areas of the country.

The present invention provides an exceptionally strong non-combustible Expandable Polystyrene And Fixed System construct at a substantial cost savings over typical EIFS prior art systems, as are outlined in FIGS. 1 and 2. Saving is achieved without sacrifice in impact resistance by employing a high density Expandable Polystyrene (EPS) panel/board in place of a layer of high impact reinforcing as shown in FIG. 3, a single layer of high impact reinforcing mesh is then attached to the high density board, and then a layer of conventional 1-pound EPS board with a light weight mesh embedded in an adhesive; a finish material, such as a stucco material or acrylic based finish coat, is then applied.

In accordance with the foregoing objective, a high impact resistant EIFS construct is achieved by using the high density EPS panel in lieu of a layer of fiberglass mesh, having the advantage of a time saving method with low cost, and ease of construction, over the standard EIFS claddings as are furnished by the various EIFS manufacturers.

DETAILED DESCRIPTION

Prior Art

Figure 1:
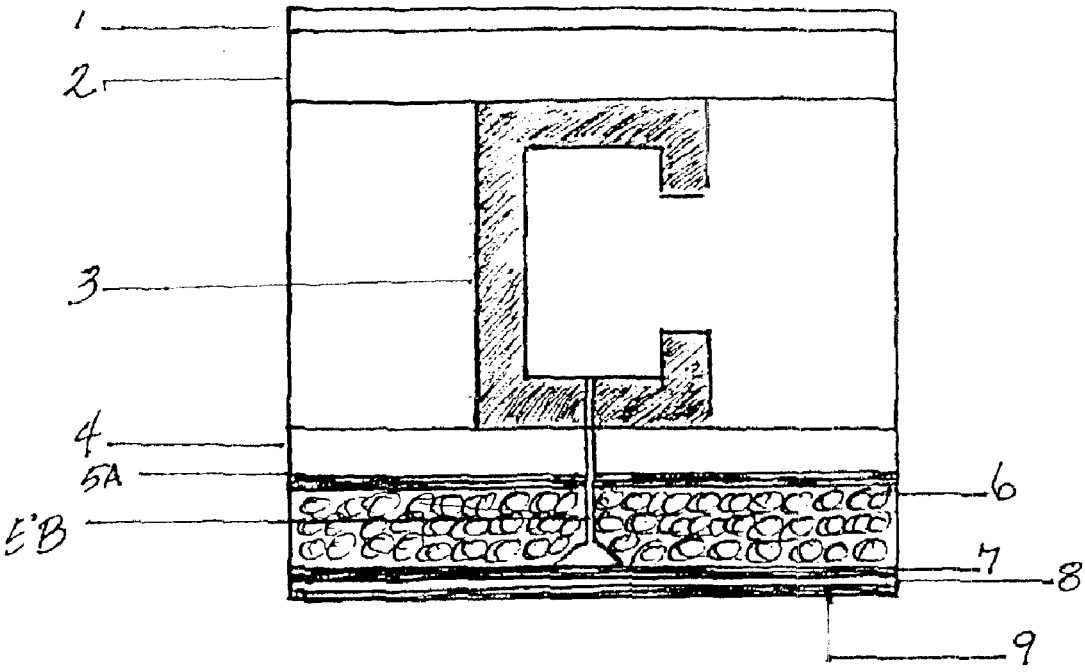
(Prior Art) Figure 1
FIG. 1 is a Cross-Sectional drawing of an EIFS construct according to the prior art, as is typically used in the industry.

An EIFS construct can be formed by the conventional EIFS method of applying the mandatory components as shown in FIG. 1. These are: A substrate system 4 (the surface to which the EIFS is attached), such as wood sheathing, mineral boards, exterior grade or glass fiber-faced gypsum board, or cement boards, which is attached to a wood or metal framing stud 3; Insulation board 6, which shall be by steam expansion of polystyrene resin beads, to a minimum weight of 0.9 to 1.1 pounds per cubic foot, and at a thickness of at least ¾ of an inch 6; Attachment systems: base coat 5A for attaching the insulation to the substrate, the attachment base coat adhesive, such as that used by the Dryvit Systems, Inc of West Warwick, R.I., consisting of a "Primus" mixed by weight with Portland Cement and water based primus, which is a 100 percent polymer based product, or 5B, a mechanical fastener, such as a screw or nail. To the base coat adhesive 7 is embedded, over the outside face of the EPS insulation board 6, for example, a Dryvit standard plus reinforcing mesh 8, typically of a weight between 4 to 5 ounces per square yard. The finish coating 9 is basically an esthetic part of the EIFS, which is the visible portion of the wall system, and is typically made from an acrylic resin, or stucco product, which is either troweled or sprayed on.

Figure 2:
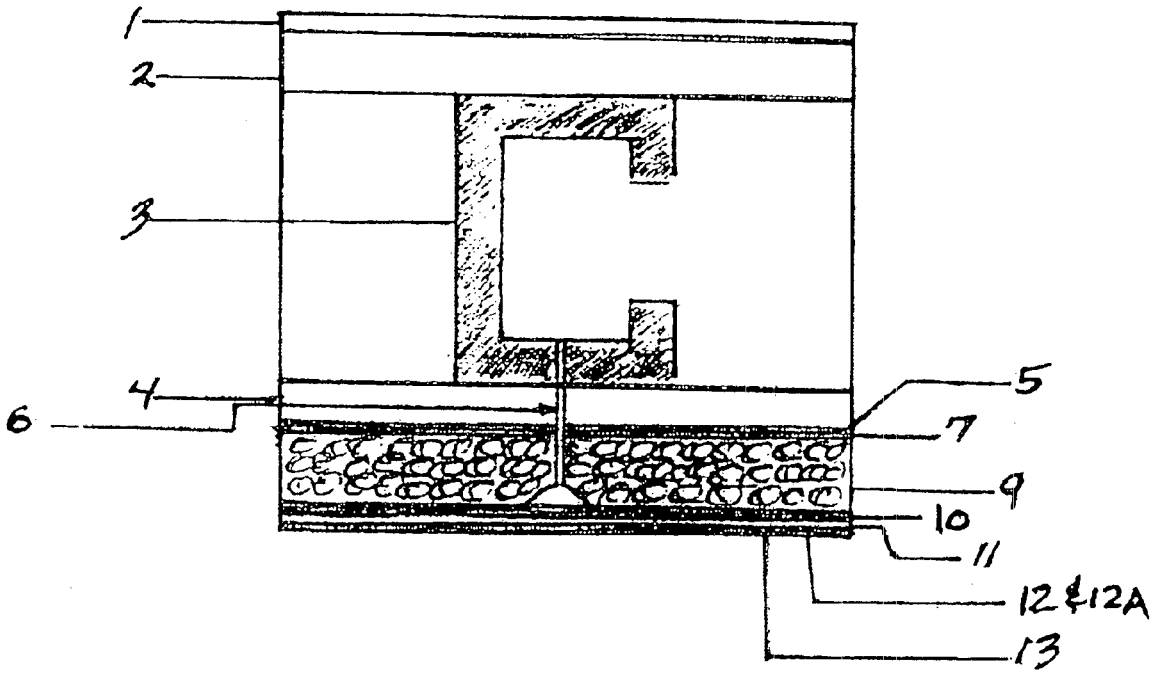
(Prior Art) Figure 2
FIG. 2 is a Cross-Sectional drawing of an EIFS construct according to the prior art, as is typically used when a non-combustible high impact EIFS system is required, either by building code or architect preference.

To the mandatory components of the construct as shown in FIG. 1 are added layers of high impact reinforcing mesh 11, as shown in FIG. 2, which are used when an EIFS is required to pass certain building codes, in for example hurricane and tornado areas of the country. The first layer of reinforcing mesh 7 is typically made of a glass woven fiber, with a weight of between 6 to 11 ounces per square yard. It is adhered to the substrate 4 with a base coat 5 consisting typically of Portland Cement with a setting additive, which is typically a 100 percent polymer based product. To this layer is added the EPS 9 by an attachment system 6A or 6B, of either a mechanical means or an adhesive, which is typically a 100 percent polymer based product mix, which may be mixed with an 100 percent acrylic based product and with water and Portland Cement. To the outside of the installed EPS board 9 is embedded, into a base coat 10 a very heavy high impact fiberglass reinforcing mesh 11, typically of a weight of between 15 to 22 ounces per square yard. Added to this layer of mesh is the standard base coat 12 and reinforcing mesh 12A, which is typically of between 4 to 6 ounces per square yard in weight. To this last layer is added the finish coat 13, which is mainly used for esthetic purposes and consists typically of a 100 percent acrylic based product. The added layers 7 & 11, of the heavy weight high impact reinforcing mesh are the integral components to the standard EIFS construct, and are a requirement in order to pass the Hurricane Testing Protocol, especially the Large Scale Missile Impact, PA 201 as is required in the Miami-Dade County South Florida Building Code.

The Present Invention

Figure 3:
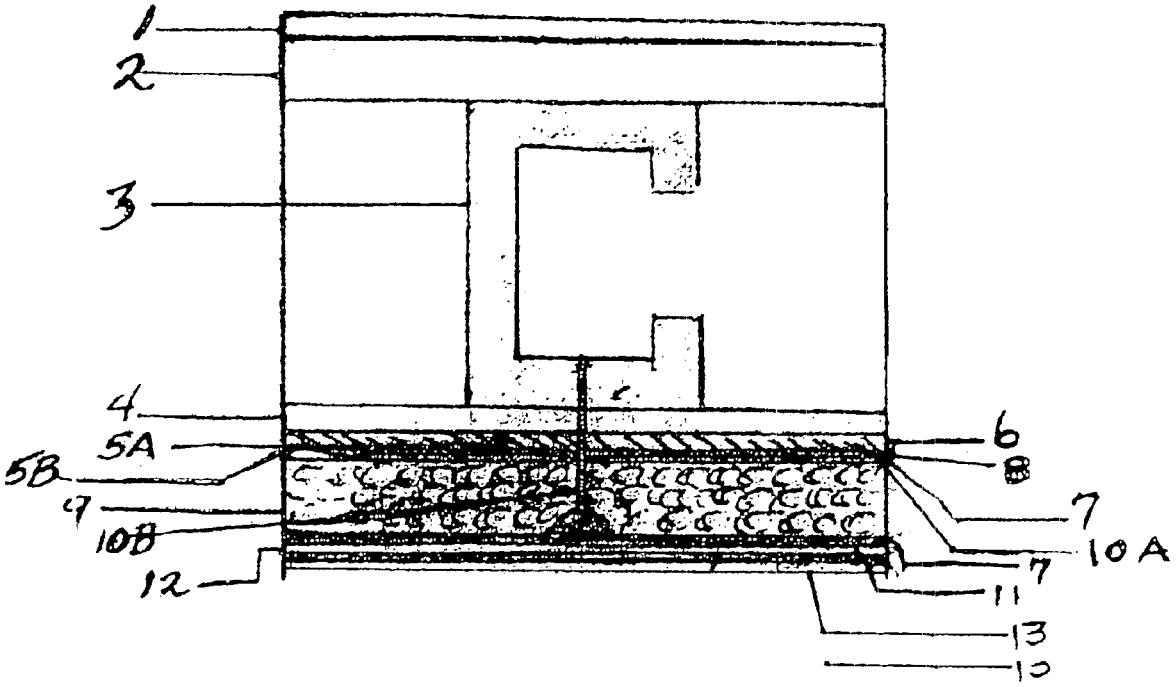
FIG. 3 is a Cross-Sectional drawing of an EIFS construct provided in accordance with present invention.

The present invention does away with one of the required layers of mesh and its attachment system that are shown in FIG. 2. FIG. 3 illustrates a construct according to the present invention. This variation to the EIFS System in its use of a high density EPS board 6 in place of the high impact fiberglass layer 7, as described above, and as depicted in FIG. 2.

Koch's 1955 U.S. Pat. No. 3,445,406 discussed the making of a high-density Expandable Polystyrene, EPS board. A refined process for producing a high-density EPS board is outlined by Cutler in his 1998 U.S. Pat. No. 5,718,968. In it he describes the making of a high-density EPS construct through a two-step molding process. Cutler uses a compression molding technique or process, which "gives" the construct more of an energy-absorbing "memory", and structural strength, without an increase in embrittlement, than what could be offered by a regularly molded high-density board. The "memory" allows for the board to withstand higher impacts, that is, when impacted the construct does not deform to the degree a regularly molded high- density construct would. In this invention a high-density board, with a density of between 11 pounds per cubic foot and 15 pounds per cubic foot is used. In regular EPS molding an EPS construct can be made up to densities of about 8 pounds per cubic foot. Regular EPS molding at such high densities is difficult and at times leaves the molded construct brittle, which is not the case when a construct is made per the process as described by Cutler. The present invention employs that process to produce the unique component of the present invention, the EPS board identified by reference numeral 6 in FIG. 3.

In the present invention as shown in FIG. 3 a newly developed non-combustible EIFS construct is detailed. This non-combustible EIFS construct is attached to a suitable wall stud, typically a 1 and ⅝ inch, at least, 16 gauge, metal stud 3, spaced at about 16 inch on centers. The construct includes a substrate of at least ¼ inch exterior or water proof grade gypsum board or other "non-combustible" sheathing material 4, which is attached either by an adhesive, screws or nails to the metal stud 3. To the sheathing substrate is attached, either through nailing, screwing 5A or an adhesive 5B or a combination thereof, the high density board 6. To the high-density board 6 is affixed a layer of high impact reinforcing fiberglass mesh 7 of at least about 11 ounces per square yard to about 20 ounces per square yard, which is embedded in a standard base coat 8 of Portland Cement and an adhesive additive, which is typically a 100 percent polymer based product. To the high impact reinforcing fiberglass mesh 7 is attached an Expandable Polystyrene (EPS) board 9 of at least ¾ inch thick with a density from between 0.9 to 1.1 pound per cubic foot. The EPS board is affixed by the use of an adhesive base coat 10A or mechanical means, such as with nails or screws 10B. Attached to the outside portion of the EPS is a standard reinforcing mesh 11 of about 4 to 5 ounces per square yard, which is embedded into a standard base coat 12 and adhesive, as is typically used in the industry. To this last layer is added the finish coat 13, which is mainly used for esthetic purposes and consists typically of a 100 percent acrylic based product.

While I have described a preferred embodiment of my invention as having the various layers in a certain order, it will be apparent to those skilled in the art that other orders may be employed. For example, the high impact mesh 7 may be the layer immediately adjacent the substrate 4, or it may be the layer immediately adjacent the mesh 11. Moreover, in some cases, it may not be necessary to include the substrate at all. The important aspect of the invention is the inclusion of both the high-density board 6 and the lower density board 9 in the construct.

Having thus described my invention, I claim:

1. A substantially flat panel construct for use in buildings and adapted to be applied to building structural elements such as wall studs or the like, comprising:

at least one layer of a high density compression molded expandable polystyrene board, having a density in the range of between 10 to 18 pounds per cubic foot, a layer of high impact reinforcing glass fiber mesh, said mesh having a density in the range of 11 to 22 ounces per square yard, a layer of a second expandable polystyrene board, said last named board having a density in the range 0.9 to 2.5 pounds per cubic foot, and a layer of reinforcing glass fiber mesh forming one outer surface of the panel construct and having a density in the range 3.5 to 6.5 ounces per square yard.

2. The construct of claim 1, wherein the high impact mesh forms the other outer surface of the construct.

3. The construct of claim 1 wherein the high-density polystyrene board forms the other outer surface of the construct.

4. The construct of claim 1 including a layer of gypsum board of at least one-quarter inch in thickness.

5. The construct for an External Insulated And Fixed System (EIFS), comprising:

a substrate system comprised of an exterior grade sheet of plywood, gypsum or other type of flammable or non-flammable board adapted to be attached to a metal or wood framing stud;

a high density compression molded expandable polystyrene board, having a density in the range of between 10 to 18 pounds per cubic foot attached to the substrate;

a high impact reinforcing glass fiber mesh, said mesh having a density in the range of 11 to 22 ounces per square yard attached to an exterior surface of the high density expandable polystyrene board;

a regular, expandable polystyrene board, said board having a density in the range 0.9 to 2.5 pounds per cubic foot attached to an exterior surface of said glass fiber mesh;

a layer of standard reinforcing glass fiber mesh having a density in the range 3.5 to 6.5 ounces per square yard attached to an exterior surface of the regular expandable polystyrene board;

an aesthetic coating covering said exterior surface of said standard reinforcing mesh.

6. The construct of claim 5, wherein the high-density board is attached to the substrate by an adhesive base coat comprising a mixture of Portland cement with a polymer-based adhesive or a fiber-reinforced 100 percent acrylic-based adhesive.

* * * * *